US005231850A

United States Patent [19]

Morris

[11] Patent Number: 5,231,850

[45] Date of Patent: Aug. 3, 1993

[54] COOLER CONTAINER

[76] Inventor: Richard Morris, 2780 NE. 183rd #917, North Miami Beach, Fla. 33160

[21] Appl. No.: 802,562

[22] Filed: Dec. 5, 1991

[51] Int. Cl.[5] ..... F25D 3/08

[52] U.S. Cl. ..... 62/457.6; 62/457.2

[58] Field of Search ..... 62/457.1, 457.2, 457.3, 62/457.6, 457.7, 371

[56] References Cited

U.S. PATENT DOCUMENTS

| | | | |
|---|---|---|---|
| 2,215,274 | 9/1940 | Peterson | 62/457.6 |
| 3,710,589 | 1/1973 | Brown et al. | 62/457.6 |
| 4,498,312 | 2/1985 | Schlosser | 62/457.7 |
| 4,732,014 | 3/1988 | Frohbieter | 62/382 |
| 4,981,234 | 1/1991 | Slaughter | 220/415 |
| 5,088,301 | 2/1992 | Piepenbrink | 62/457.6 |

FOREIGN PATENT DOCUMENTS

| | | | |
|---|---|---|---|
| 2925499 | 1/1981 | Fed. Rep. of Germany | 62/457.6 |

*Primary Examiner*—Albert J. Makay
*Assistant Examiner*—William C. Doerrler
*Attorney, Agent, or Firm*—Malloy & Malloy

[57] ABSTRACT

A portable container which may be refrigerated is provided which is composed of a floor and wall composed of an inner and outer wall with refrigerant captivated between these walls and a lid to close the container which also contains a charge of refrigerant in a recess therein, a labyrinth-type seal is provided between the lid and the wall composed of interdigitated ridges.

2 Claims, 1 Drawing Sheet

COOLER CONTAINER

BACKGROUND OF THE INVENTION

Field of the Invention

This invention relates to a container and more particularly to a container which is adapted to be placed in a freezer so that liquid gel comprising the walls is cooled so that, subsequently, material in the container may be maintained in a chilled condition.

SUMMARY OF THE INVENTION

There has long been a need for a container in which materials can be positioned which are chilled and which will remain cooled. For example, potato salad would be chilled placed in the container and, thereafter, maintained in the chilled condition for use, for example, at a picnic.

In the past, there have been numerous types of containers for maintaining items in a cooled condition. For example, U.S. Pat. No. 4,377,075 is of a styrofoam container in which a self-contained refrigerant package for a perishable product is positioned in an insulated container with dry ice while the product itself is contained in a wrap in which the refrigerant is contained. U.S. Pat. No. 2,496,296 illustrates a portable refrigerated container, in which various sections of a wall may be removed, refrigerated, and replaced. The refrigerating walls of this reference are in effect lined with refrigerant in separate packages.

It is an object of this invention to provide a refrigerant container, the walls and floor of which are completely filled with a refrigerant and closed and wherein the lid is similarly provided with refrigerant and the lid and the container are adapted to be connected together defining a labyrinth seal means at their zone of juncture so that materials in the container remain chilled for an extended period of time.

BRIEF DESCRIPTION OF THE DRAWINGS

In accordance with this general invention, the disclosure follows herein wherein reference is made to the accompanying drawings in which.

Like reference numerals refer to like parts throughout the several views of the drawings.

DESCRIPTION OF THE PREFERRED EMBODIMENT

Figure 1:
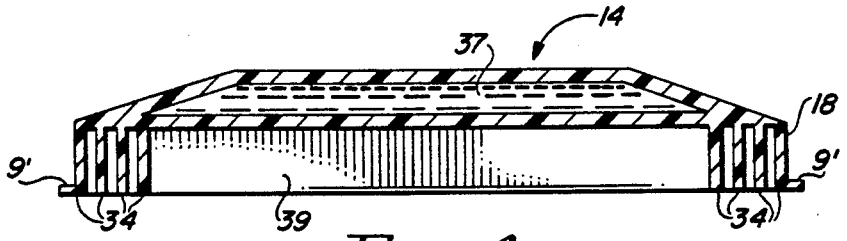
FIG. 1 is a side elevation view in cross-section of the lid.
Figure 2:
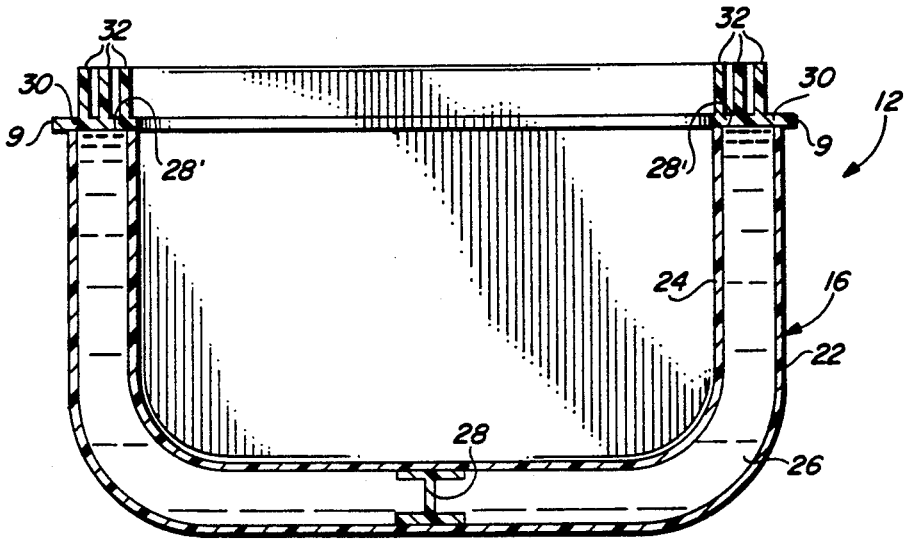
FIG. 2 is a view of the container in cross-section.
Figure 3:
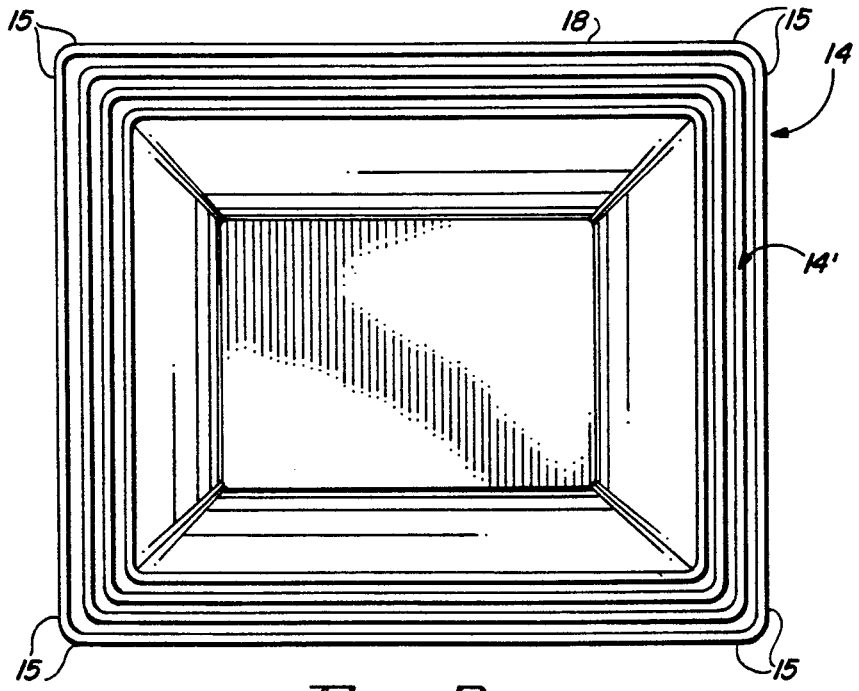
FIG. 3 is a bottom plan view of the lid seen in FIG. 1.

The container generally designated in FIG. 2 of the drawings by the numeral 12 is composed of a cooler, the purpose of which is to preserve perishables. The container includes an airtight lid 14 and may be square, rectangular, oval, round or bowl-shaped. The material of which it is made is clear or light blue and is preferably made of plastic. There is a labyrinth seal means 14' at the top of the container wall 16 which mates with the peripheral zone 18 of the lid. The container includes a floor as well as the wall and lid. The container floor and wall are composed of a thin inner and spaced, rigid, outer plastic skin 22, 24 which defines the floor and the upstanding wall and defining a cavity 26 between the inner and outer skins. A center post 28 may be provided to maintain the skins in spaced relation during the assembly. The upper end of the inner and outer skins define an annular opening 28' and through this opening refrigerant gel is introduced into the cavity 26 or space between the inner wall and outer wall. The upstanding terminal end of the wall is closed by a ring member 30 which may have three upstanding annular ridges, see 32. In such a case, the lid similarly has three mating downwardly extending annular ridges, see 34, on its peripheral zone. These ridges are sized and spaced to interdigitate when the lid is positioned as shown in the drawings in covering relation of the container. Thus, a labyrinth seal is formed. The lid is preferably provided with a recess opening, not shown, through which gel 37 may be introduced in any suitable manner in the manufacture of the lid. Preferably, the lid includes a downwardly extending skirt 39 which fits within the inner skin or inner wall of the container thus providing an additional seal surface when it is pressed down to mate with the perimeter of the container. It is thus seen that the three rings about the peripheral zone of the lid and the perimeter of the container provide a highly effective seal. In a preferred embodiment the terminal ends of the ridges or rings will have a contrasting color, such as red, while the bowl may be transparent without color so that the red can be seen through the lid from the outside of the container. Whether the container shape is square, round, rectangular, or oval, it has a plastic exterior wall or skin that follows the design of the interior plastic wall or skin of the container so that the area between the interior and exterior skins is hollow. This cavity is filled with a refrigeratable gel or liquid which surrounds the entire container, top, sides and bottom. The gel is to be frozen when the container is placed in the freezer and thereafter when in use, the contents of the container will remain chilled. It will be apparent that the refrigerating gel never touches the contents of the container and that the gel is completely sealed within the hollow wall of the container. In the embodiment shown in FIG. 3, on the corners of the lid, for example, lift tabs or handles 15 may be provided for lifting the lid from the container and if desired, handles may be provided on the container also. In a preferred embodiment, the outer wall may be out-turned to form a peripheral flange 9 and the lid may also be out-turned as at 9' to overlay and rest on the flange 9.

The lid, whether round, rectangular, square, or oval, has the labyrinth seal for the entire perimeter of the lid which when placed on top of the container provides a very effective seal. The distance from the outside to the inside of the lid lock is preferably ½".

While this invention has been shown and described in what is considered to be a practical and preferred embodiment, it is recognized that departures may be made within the spirit and scope of this invention which should, therefore, not be limited except as set forth in the following claims and within the doctrine of equivalents.

What is claimed is

1. A cooler container comprising a floor, wall, and lid, said wall having an upper end surface and said container including:

an outer liquid impervious rigid plastic skin defining the outer surface of the floor and wall, and an inner skin of liquid impervious rigid plastic material spaced from said outer skin defining a container chamber between the skins, spacer means to hold the skins in spaced relation from one another in chamber defining relation, liquid impervious material closing the chamber at the upper end surface between the inner and outer skins and comprising an annular lip with an upwardly facing surface, a lid sized to span the lip and close said container, said lid comprising a peripheral zone with a downwardly facing surface, said lip upwardly facing surface and said peripheral zone downwardly facing surface each including extending mutually intercooperating annular ridge means sized to interdigitate when covering the container to form a labyrinth seal between the lip and lid, said lid having a recess bounded by said peripheral zone, said lid including a downwardly extending skirt portion devised for a snug receipt within the container and in abutting engagement with the inner skin, and a gel means in the container chamber and in the lid recess to be cooled to maintain the interior of the container in a cool condition.

2. The container as set forth in claim 1 wherein said ridge means comprises six interdigitated ridges.

* * * * *